United States Patent [19]

Kasboske

[11] Patent Number: 4,713,736

[45] Date of Patent: Dec. 15, 1987

[54] MULTIPLE COLOR LAMP

[75] Inventor: George C. Kasboske, Chicago, Ill.

[73] Assignee: Quintech Corporation, Chicago, Ill.

[21] Appl. No.: 9,238

[22] Filed: Jan. 30, 1987

Related U.S. Application Data

[63] Continuation-in-part of Ser. No. 791,417, Oct. 25, 1985, Pat. No. 4,644,452.

[51] Int. Cl.[4] ..... F21M 3/14

[52] U.S. Cl. ..... 362/214; 362/212; 313/112

[58] Field of Search ..... 362/211, 214, 293, 212; 313/112, 477 R

[56] References Cited

U.S. PATENT DOCUMENTS

| | | | |
|---|---|---|---|
| 676,952 | 6/1901 | Hussey | 362/212 |
| 1,224,064 | 4/1917 | Booream | 362/212 |
| 1,262,394 | 4/1918 | Schickerling | 362/214 |

*Primary Examiner*—E. Rollins Cross

*Attorney, Agent, or Firm*—Wood, Dalton, Phillips, Mason & Rowe

[57] ABSTRACT

According to the invention, a single headlamp is provided to selectively project a first color light, a second color light or a desired blend thereof. Preferably, a clear bulb contains a second bulb with a yellow light transmitting surface. Each bulb has a filament light source which can be selectively powered to produce white and yellow light, with the latter being effective for penetration of fog, dust, smoke, etc. with the lamp used on a moving vehicle.

17 Claims, 7 Drawing Figures

MULTIPLE COLOR LAMP

CROSS REFERENCE

This is a continuation-in-part of application Ser. No. 791,417 filed Oct. 25, 1985 and entitled "Vehicle Headlamp With Fog Penetrating Capability", now U.S. Pat. No. 4,644,452.

BACKGROUND ART

1. Field of the Invention

This invention relates to lamps, such as those used on moving vehicles and, more particularly, to a high intensity lamp capable of selectively projecting multiple light colors.

2. Background of the Invention

Conventional sealed beam headlamps, used on automobiles, other high speed vehicles and off road vehicles, employ a filament to project while light through a clear, light-transmitting element, which is typically glass or plastic. Many competing objectives come into play in headlamp design. A high intensity lamp that clearly illuminates a highway far in front of a moving vehicle subjects oncoming traffic to the glaring brightness of the unconcealed filament under normal driving conditions. In the presence of fog, dust, snow, rain and/or smoke, the light projected from the headlamp tends to reflect back and obstructs the vision of the vehicle operator without illuminating in front of the vehicle sufficiently to make travel at high speed safe. Fog lamps, which project yellow light that has good penetrating capability in fog, dust, snow, rain and/or smoke, normally do not alone have the intensity to satisfactorily illuminate a roadway at high speeds with unobstructed visibility.

It has heretofore been common to provide both sealed beam white light lamps and fog lamps on the same vehicle. This requires mounting at least four headlamps, which is very costly to the consumer. Further, the consumer must bear the burden of replacing twice as many headlights when the lights burn out.

As an alternative to providing separate fog and white light headlamps, a combination yellow and white light lamp is described in my U.S. Pat. No. 4,586,116 entitled "Vehicle Headlamp". While that particular light construction gives adequate illumination under both normal and adverse weather conditions, the vehicle operator may prefer to project only white or yellow light as conditions may dictate.

SUMMARY OF THE INVENTION

The present invention is specifically directed to overcoming the above enumerated problems in a novel and simple manner.

According to the invention, a single lamp is provided to selectively project a first or second color light or desired combination thereof. Preferably, the light colors are white and yellow, though any other colors or colors additional to the two colors may be provided.

More specifically, one embodiment of the invention comprises an improvement in a bulb with a first light source and having a first light transmitting surface for causing light from the first source transmitted therethrough to have a first color. The improvement comprises a second bulb contained within the first bulb with a second light source and having a second light transmitting surface for causing light from the second source transmitted therethrough to have a second color.

The lamp is particularly suitable as a vehicle headlamp, and preferably, the second light transmitting surface is yellow because of the superior penetrating capability of light in the yellow wave length range in fog, smoke, snow, rain and/or dust. A power control allows the separate light sources to be selectively powered to project white or yellow light or a combination thereof which best suits the particular driving conditions.

In a preferred form the first bulb has a cylindrical shape to control reflection from the light sources. In a headlamp where a reflector is employed, preferably the second light source is remote from the reflector and shielding structure is provided to obstruct passage of light from the first source through the second bulb. This gives a sharp division of white and yellow light, when one or the other is desired exclusively.

The present invention can be simply incorporated into a conventional headlamp that is approved for highway driving. The second bulb can be separately formed from the first bulb and readily incorporated therewithin. This facilitates manufacturing and reduces attendant costs.

It should be understood that the inventive lamp has applications other than to illuminate in front of a moving vehicle. For example, the bulb can be incorporated into a head-held flashlight or any other illuminating structure.

Other objects and advantages of the invention will become apparent upon reveiwing the following detailed description, taken in conjunction with the claims and the appended drawings.

DETAILED DESCRIPTION OF THE DRAWINGS

Figure 1:
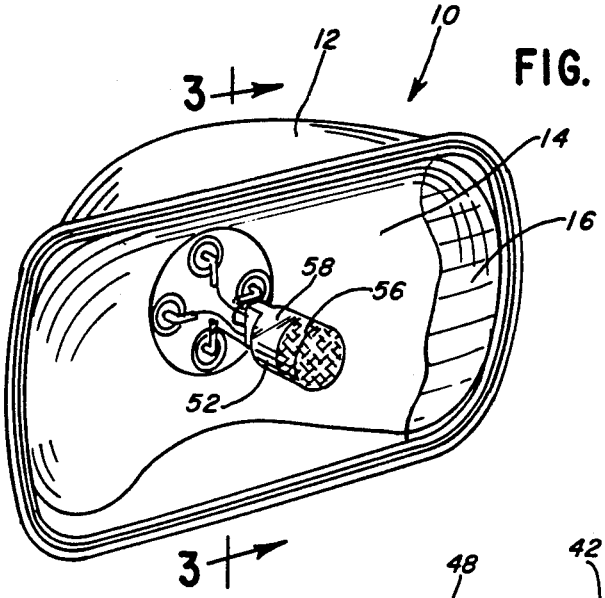
FIG. 1 is a perspective view of a conventional type headlight housing with a bulb according to the present invention incorporated.

A sealed beam headlamp is depicted in FIG. 1 at 10. The conventional portion of the headlamp 10 comprises a molded plastic housing 12 with a forwardly facing parabaloidal reflective surface 14 enclosed by a glass plastic light transmitting element 16. The surface 14 is made reflective by a thin coating 17 of aluminum or the like applied as a vapor in vacuum. At the rear of the housing 12 are integrally formed bosses 18 (FIG. 2), which serve as support for contacts to establish electrical connection between a power source and bulb, as hereinafter described.

Figure 2:
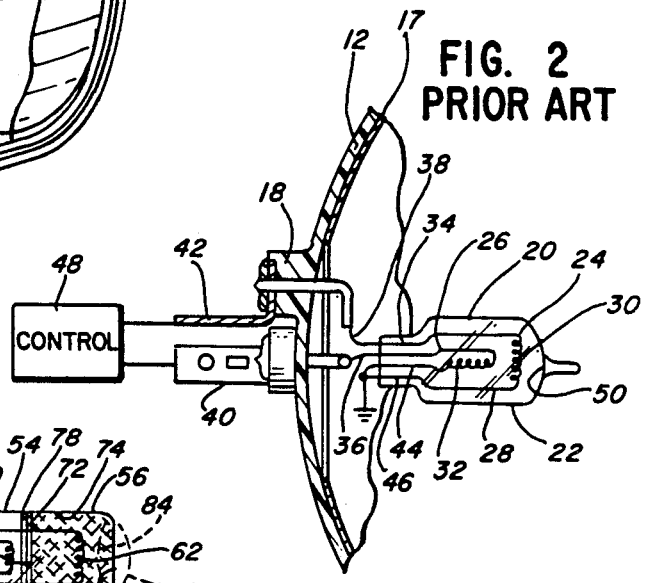
FIG. 2 PRIOR ART
FIG. 2 is a fragmentary, sectional view of a bulb on a conventional headlamp.

A conventional bulb 20 is shown in operative position in the housing 12 in FIG. 2. The bulb has a cylindrical body 22 defining an internal enclosed chamber 24 and contains a high beam filament 26 and a low beam filament 28. Typically the filaments are made from tungsten and project light through coiled portions 30, 32 shown respectively on filaments 26, 28. The rear portion of the bulb 34 is collapsed to seal about the filament leads so that the chamber can be filled with an inert gas to enhance illumination.

The supply leads 35, 38 for the high and low beam filaments project through the bosses 18 and are soldered to blade-type male contacts 40,42 which are arranged for press fit reception in a conventional electric socket associated with the vehicle to which the headlamp is attached. The ground wires 44, 46 for the high and low beam filaments are in electrical contact with an additional blade connector (not shown). The wires 44, 46 are shown schematically grounded in FIG. 2.

With the conventional bulb in place, the high and low beam filaments are selectively powered by a conventional control switch 48, which causes one or the other of the filaments to project light. The coil with the high beam filament coincides with the focal point for the parabaloidal reflective surface 14. Light rays from the high beam filament project forwardly in substantially parallel, concentrated relationship to maximize the range and intensity of the light. The coil in the low beam filament is situated slightly forwardly of the coil in the high beam filament, and, by reason of its situation forwardly of the focal point for the headlamp, causes light rays to converge resulting in a greater light dispersion and reduces the effective range of the lamp. To control the direction of light rays tending to project forwardly of the filaments, the forward surface 50 of the bulb is concave, opening rearwardly and silvered or otherwise made reflective so that light rays are rebounded toward the principal reflecting surface 14 in the housing 12 for dispersion thereby.

Since the 1950's it has been common for car manufacturers to provide four headlamps for improved illumination. The outer lamps are the double-filament type as described in the preceding paragraphs. The inner lamps have a single filament high beam of high wattage to produce a spot-light effect. The low beams of the two outer lamps both are focused toward the right and used when meeting other vehicles head on or when overtaking a vehicle. With no approaching traffic, all four high beam lamps can be safely utilized.

Figure 3:
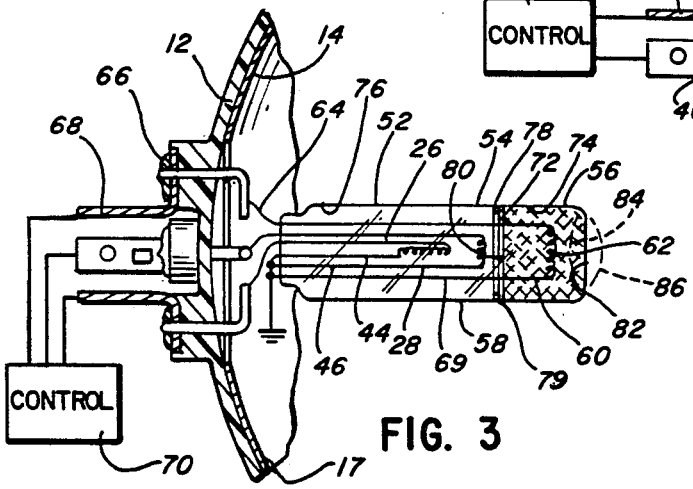
FIG. 3 is a fragmentary, sectional view of the inventive headlamp along line 3—3 of FIG. 1.

One embodiment of the invention is depicted in FIGS. 1 and 3. In those figures, a two color bulb 52 is shown having a cylindrical, light transmitting body 54 whose axis extends forwardly of the reflecting surface 14 of the housing 12. The front portion 56 of the bulb is colored, preferably yellow, while the rear portion 58 of the bulb is clear. The coloring of the front portion 56 of the bulb can be accomplished by molding in the color, dipping a clear bulb, attaching a colored, light transmitting sleeve or by other conventional means known in the art. It should be understood that while white and yellow are disclosed for the bulb colors, any combination of colors is within the scope of the present invention.

The bulb 52 is configured and colored so that the high beam filament 26 and low beam filament 28 are axially within the bounds of the clear rear portion of the bulb. The high and low beam filaments can be identically located as in the prior art bulb 20 shown in FIG. 2. A third filament 60 extends axially with respect to the bulb forwardly of the high and low beam filaments 26, 28 and has a coiled portion 62 axially intersecting the front, colored portion 56. The filament 60 has a lead 64 which is soldered to the housing at 66 and establishes electrical contact with a blade type contact 68. The filament 60 is grounded commonly with the ground leads 44, 46 of the high and low beam filaments through lead 69.

A switching control 70, of a type known to those skilled in the electrical art, allows the operator to selectively power the high beam filament 26, low beam filament 28 and/or additional filament 60. The operator can thereby choose between projecting white light through the high beam or low beam filaments or yellow light through the filament coil 62. By incorporating a rheostat into the control, it is possible to blend white and yellow light depending upon the driving conditions. For example, thick fog may dictate the use of entirely yellow light, whereas slightly dusty conditions may require only a small amount of yellow light intermixed with the white light. It can be seen that by modifying a conventional bulb that is approved for highway operation, one does not affect the operation of the white light portion of the lamp and improves the versatility of the headlamp.

To prevent undersired mixing of light inside the bulb 52 a disk-shaped baffle 72 is mounted within the bulb and defines forward and rear chambers 74, 76 respectively. The baffle is preferably made from tungsten or other suitable material that withstands heat and will not transmit light. An annular gap 78 is maintained about the baffle on the order of approximately 1/32 of an inch to accommodate expansion when the bulb becomes heated. The baffle can be suspended in the bulb in operative position by a plurality of spacers 79 arranged about the peripheral edge of the disk-shaped baffle 72. The baffle is located axially rearwardly with respect to the bulb from the edge 80 of the yellow colored front portion 56 of the bulb. Preferably the spacing is on the order of $\frac{3}{8}$". This arrangement tends to shield the yellow colored portion of the bulb effectively from rays emanating from the high and low beam filaments.

As with conventional bulbs, the forward, free edge 82 of the bulb 52 is coated with a reflective medium to direct forwardly projecting light back to the reflective surface 14. The forward surface 82 in FIG. 3 is shown flat but may be otherwise concave opening forwardly as shown in phantom at 84 or concave opening rearwardly as shown in phantom at 86 in FIG. 3. The rays otherwise tending to concentrate immediately forward of the filaments are directed back for more effective dispersal. The axial extent of the curvature is approximately $\frac{1}{4}$" from the apex of the curve to the juncture of the curve and cylindrical bulb body. The coating on the surface 82 may be silver, chrome oxide or other reflective material known by those skilled in the art.

Figure 4:
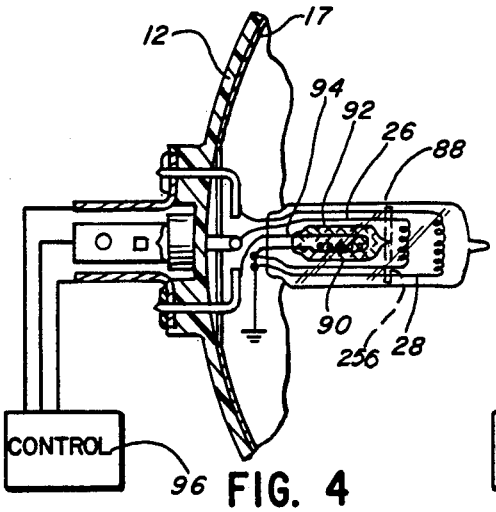
FIG. 4 is a view similar to that in FIG. 3 with a modified bulb construction according to the present invention.

As an alternative to the embodiment in FIGS. 1 and 3, FIG. 4 discloses a bulb 88 with corresponding high and low beam filaments 26, 28 respectively, which bulb 88 entirely contains a separate bulb 90 that has a light transmitting surface 92 that is preferably yellow colored. The filament 94 associated with the bulb 90 and the filaments 26, 28 are selectively powered by a control 96 in similar fashion to the prior embodiment. The embodiment in FIG. 4 is in all other respects operable in the same manner as the prior embodiment.

Figure 5:
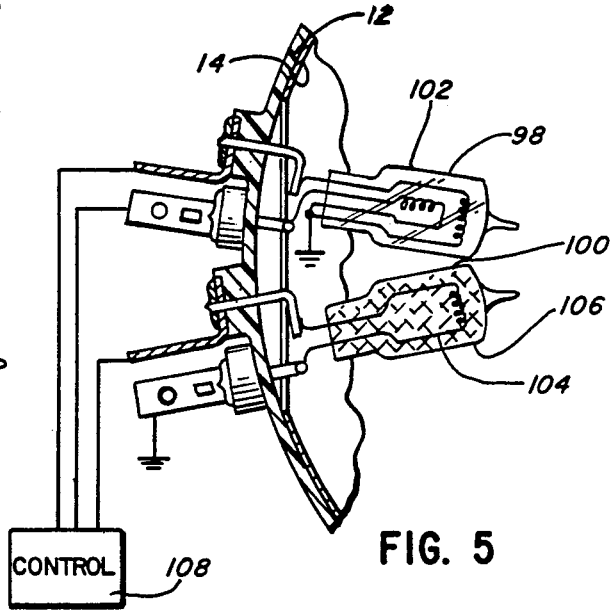
FIG. 5 is a view similar to that in FIGS. 3 and 4 with a modified headlamp structure according to the present invention.

As an alternative to situating separate bulbs in coaxial relationship, one within the other as in FIG. 4, two separate bulbs 98, 100 are disclosed in FIG. 5. The bulb 98 is a conventional high-low beam bulb with a clear light transmitting surface 102. The bulb 100 contains a single filament 104 and has a light transmitting surface 106 that is yellow colored throughout. Powering of the bulbs 98, 100 is accomplished selectively in the same manner as in the prior embodiments through a switch control 108. The arrangement of the bulbs 98, 100 with respect to the housing 12 is only exemplary. The bulbs might be vertically spaced or horizontally spaced from one another. As a still further alternative, the bulbs 98, 100 may be stacked in a forward direction so that the bulb 100 is placed forwardly of the white bulb 98, though the bulbs remain independently operable. It is desired to situate the filament coils as close to the focal point for the reflective surface 14 as possible, yet it is desirable to keep as much light as possible from the powered bulb from finding its way through the bulb that is switched off.

Figure 6:
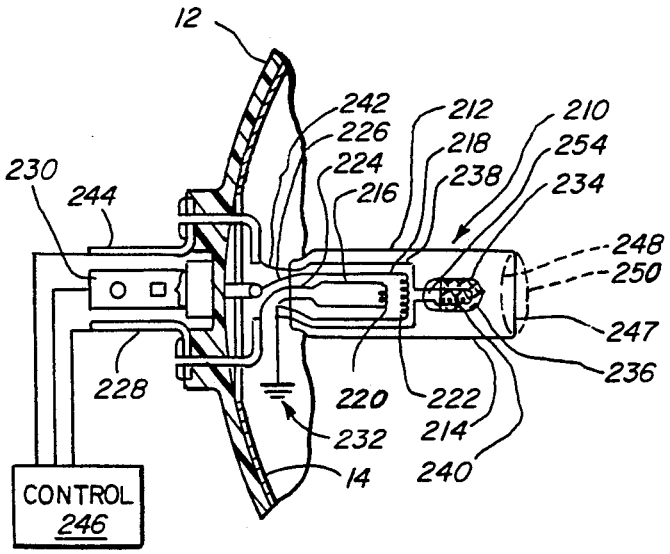
FIG. 6 is a view similar to that in FIGS. 3-5 and showing a second modified bulb construction according to the present invention.

A modified form of the bulb in FIG. 4 is shown in FIG. 6. As in all of the prior embodiments, a housing 12 with a forwardly facing parabaloidal reflective surface 14 is utilized. A combination bulb according to the invention is shown at 210 in operative association with the housing 12. A first bulb 212 has a generally cylindrical, clear, light transmitting surface 214. The bulb 212 contains a high beam filament 216 and a low beam filament 218. Light is projected from a coiled portion 220 of the high beam filament 216 and a coiled portion 222 of the low beam filament 218, with the former coiled portion 220 residing between the coil portion 222 and the housing reflecting surface 14. As in the prior embodiments, power leads 224, 226, associated with high and low beam filaments 216, 218 respectively, are connected to conduct through blades 228, 230, which can be press fit into conventional connectors (not shown), which facilitate replacement of the headlamp. The leads 224, 226 are shown to be grounded commonly at 232.

A second bulb 234 is contained entirely within the first bulb 212 and is situated forwardly of the coiled filament portion 222. The second bulb has a substantially cylindrical light transmitting surface 236. A third filament 238 has a light producing coiled portion 240 residing within the second bulb 234 and powered through a lead 242 connected to a blade connector 244, similar to the blade connectors 228, 230. The filament 238 is also grounded at 232.

A conventional control 246 is used to selectively power the high beam filament 216, low beam filament 218 and third filament 238. As in the prior embodiments, the control 246 can be such as to power any one filament to the exclusion of the others or may incorporate a rheostat so that a mixing of a predetermined amount of light from the separate filaments can be accomplished.

Preferably, the light transmitting surface 214 is clear and the light transmitting surface 236 is yellow or amber, with the latter color chosen to effectively penetrate smoke, dust, fog, etc. If the third filament 238 is powered, to the exclusion of the other filaments 216, 218, the light projecting from the second bulb 234 forwardly and also reflecting back off the surface 14 is yellow light. Forward projection of the yellow light can be controlled by changing the configuration of the flat, front wall 247 of the bulb 212 and/or by optionally coating the wall 247. For example, as shown by dotted line 248, the wall 247 may be concave opening forwardly. Alternatively, as shown by dotted line 250, the wall 247 may be concave opening rearwardly. A conventional type coating can be applied to the rearwardly facing surfaces of any of the three wall configurations to reflect light back to the surface 14 and effect a desired dispersion thereof.

With either of filaments 216, 218 powered, much of the light projects forwardly towards the second bulb 234. To prevent passage of the light from the filaments 216, 218 through the light transmitting surface 236, as would thereby project yellow light forwardly, a conventional, light blocking coating 254 is applied to the rearward portion of the bulb 234.

Figure 7:
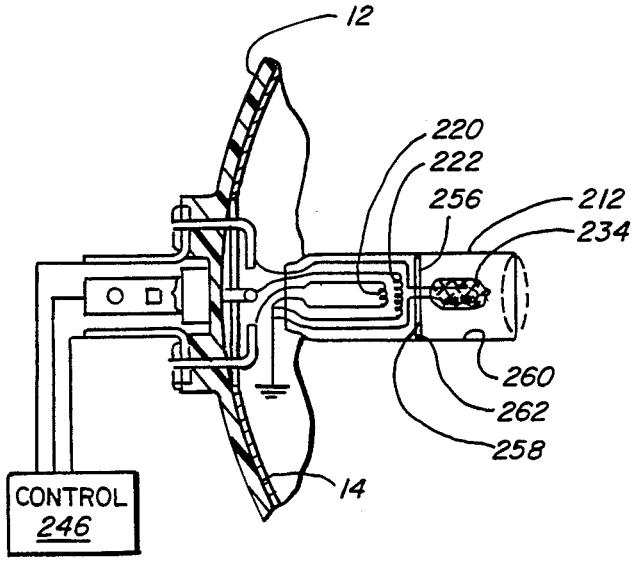
FIG. 7 is a view similar to that in FIGS. 3-6 and showing a third modified bulb construction according to the present invention.

As an alternative to the use of a coating as in FIG. 6, a baffle 256 can be used, as shown in FIG. 7. The light in FIG. 7 is the same as that in FIG. 6 in all respects other than the omission of the coating 254 and the substitution therefor of a baffle 256. The baffle 256 has a disk-shaped configuration and an outer peripheral surface 258 that has a diameter that is slightly less than the diameter of the inside surface 260 of the bulb 212. A plurality of spacers 262 are disposed about the periphery of the baffle 256 to maintain a slight annular spacing between the baffle 256 and bulb 212. The baffle is preferably made from tungsten or other suitable material that can withstand the anticipated amount of heat generated by the filaments and will not transmit light. The baffle 256 is disposed between the coiled filament portion 222 and the bulb 234 and is spaced slightly from both. The baffle 256 serves the same purpose as the coating 254 on the bulb 234 in FIG. 6. An identical baffle 256 is shown in the bulb in FIG. 4 and is optionally placed in that configuration bulb for the same reasons as it is placed in the bulb in FIG. 7.

The combination bulbs shown in FIGS. 4, 6 and 7 are capable of being readily manufactured. A high integrity yellow bulb can be preformed and simply incorporated into an encasing bulb.

While the invention has been described with respect to a vehicle headlamp, the inventive concept may be employed in any type of lamp i.e. bulbs for home use. Wherever it is desirable to project different colored lights from a common source, the present invention is appropriate.

The foregoing detailed description was made for purposes of demonstrating the structure and operation of the present invention, with no unnecessary limitations to be understood therefrom.

I claim:

1. In a lamp having a first bulb with a first light source and a first light transmitting surface for causing light transmitted therethrough by the first light source to have a first color, the improved comprising:

a second bulb contained substantially within said first bulb, said second bulb having a second light transmitting surface for causing light transmitted therethrough to have a second color;

a second source for transmitting light through said second light transmitting surface; and means for at least partially shielding said second light transmitting surface from light from said first light source.

2. The improved lamp according to claim 1 including means for selectively powering said first and second light sources.

3. The improved lamp according to claim 1 wherein said shielding means comprises a baffle and means mounting the baffle within said first bulb.

4. The improved lamp according to claim 1 wherein said shielding means comprises a light blocking coating on the second bulb.

5. In a vehicle lamp of the type having a reflector, a first bulb having a first light transmitting surface and a first light source which when powered causes a first color light to be transmitted through said first light transmitting surface and towards said reflector, the improvement comprising:

a second bulb contained substantially within said first bulb, said second bulb having a second light transmitting surface for causing light transmitted therethrough to have a second color;

a second source for transmitting light through said second light transmitting surface; and means for at least partially shielding said second bulb from light from said first light source.

6. The improved vehicle lamp according to claim 5 wherein said shielding means comprises a baffle means mounting the baffle within said first bulb.

7. The improved vehicle lamp according to claim 5 wherein said shielding means comprises a light blocking coating on the second bulb.

8. The improved vehicle lamp according to claim 5 wherein said first light transmitting surface is substantially clear and the second light transmitting surface is substantially yellow so that light transmitted through the second light transmitting surface effectively penetrates fog, snow, dust and the like.

9. A vehicle lamp comprising:

a reflector;

a cylindrical bulb having a first light transmitting surface and a first light source which when powered causes a first color light to be transmitted through said first light transmitting surface;

means for mounting the cylindrical bulb relative to the reflector so that light from said first light source is directed toward said reflector;

a second bulb contained substantially within said first bulb, said second bulb having a second light transmitting surface for causing light transmitted therethrough to have a second color; and a second source for transmitting light through said second light transmitting surface.

10. The vehicle lamp according to claim 9 including means for selectively powering said first and second light sources.

11. The vehicle lamp according to claim 9 including means for at least partially shielding said second bulb from light from said first light source.

12. The vehicle lamp according to claim 9 wherein said first light transmitting surface is clear.

13. The vehicle lamp according to claim 9 wherein said second light transmitting surface is yellow.

14. The vehicle lamp according to claim 9 wherein said first light source resides between the reflector and the second light source.

15. The vehicle lamp according to claim 10 wherein said powering means comprise rheostat means for selectively controlling the first and second light sources to produce a desired mix of yellow and white light.

16. The vehicle lamp according to claim 11 wherein said shielding means comprises a baffle and means mounting the baffle within said first bulb.

17. The vehicle lamp according to claim 1 wherein said shielding means comprises a light blocking coating on the second bulb.

* * * * *